US005551842A

United States Patent [19]

Schmid et al.

[11] Patent Number: 5,551,842

[45] Date of Patent: Sep. 3, 1996

[54] UNIT FOR DELIVERING FUEL FROM A SUPPLY TANK TO THE INTERNAL COMBUSTION ENGINE OF A MOTOR VEHICLE

[75] Inventors: Werner Schmid, Tamm; Manfred Treter, Moeglingen, both of Germany

[73] Assignee: Robert Bosch GmbH, Stuttgart, Germany

[21] Appl. No.: 318,394

[22] Filed: Oct. 5, 1994

[30] Foreign Application Priority Data

Oct. 22, 1993 [DE] Germany ..... 43 36 090.4

[51] Int. Cl.[6] ..... F04B 23/14

[52] U.S. Cl. ..... 417/203; 417/205; 417/423.3; 415/55.1

[58] Field of Search ..... 417/201, 203, 417/205, 423.1, 423.3; 415/55.1

[56] References Cited

U.S. PATENT DOCUMENTS 5,378,125 1/1995 Frank et al. ..... 415/55.1
5,393,203 2/1995 Hantle ..... 417/205
5,401,143 3/1995 Yu ..... 417/203

FOREIGN PATENT DOCUMENTS 4020521 1/1992 Germany .

*Primary Examiner*—Charles Freay
*Attorney, Agent, or Firm*—Edwin E. Greigg; Ronald E. Greigg

[57] ABSTRACT

A device for delivering fuel from a storage tank to the engine of a motor vehicle, having a two-stage feed pump driven to rotate by an electric drive motor. The preliminary stage of the feed pump is embodied as a side channel pump whose partially ring-shaped supply conduit has in its pump course a cross sectionally reduced region, which is constituted by means of a reduction of the conduit depth and in which the fuel flowing through the supply conduit is maintained at a constant pressure level so that the length of the supply conduit effective for a pressure increase can be reduced to achieve a quick increase of delivery pressure.

8 Claims, 3 Drawing Sheets

UNIT FOR DELIVERING FUEL FROM A SUPPLY TANK TO THE INTERNAL COMBUSTION ENGINE OF A MOTOR VEHICLE

BACKGROUND OF THE INVENTION

The invention is based on a delivery unit for delivering fuel from a supply tank to an internal combustion engine of a motor vehicle. German Offenlegungsschrift 40 20 521 discloses a delivery unit of this kind in which an electric drive motor drives an impeller to rotate which has radially outward pointing blades and which revolves in a pump chamber of a feed pump, which is embodied as a side channel pump, by means of which the fuel in a ring-shaped supply conduit in the axial face end chamber wall of the pump chamber in the region of the free ends of impeller blades is impelled into a rotating, whirling stream. This stream gets steadily stronger in the supply conduit from the low pressure fuel inlet opening to the end-of-delivery pressure outlet opening; the delivery pressure in the supply conduit also steadily increases via the conduit's circumference.

But the known fuel delivery units have the disadvantage that the efficiency of the pump decreases with increasing fuel temperature; in particular the delivery pressure at the outlet opening when the fuel is highly heated is far below the delivery pressure when the fuel is cold. This can be traced back to the whirling stream in the supply conduit, which causes a vacuum in its center, whose magnitude can reach 50% of the end-of-delivery pressure, so that highly heated fuel in this vacuum region begins to vaporize. The slower the pressure in the supply conduit increases, the more time the heated fuel has to vaporize; the vaporized fuel leads to a further delay of the pressure increase.

This effect is also involved in the fuel delivery units known from German Offenlegungsschrift 40 38 438, among other sources, whose feed pumps have a preliminary stage and a main stage; the preliminary stage is embodied by a side channel pump and the main stage by an internal gear pump, whose rotating pump parts are disposed on a common rotor shaft driven by an electric motor. In these known fuel delivery units, the highly heated fuel can lead to a failure of the preliminary stage, which strongly impairs the efficiency of the entire delivery unit and furthermore can cause cavitation damage, especially in the main stage.

OBJECT AND SUMMARY OF THE INVENTION

The delivery unit according to the invention has an advantage over the prior art that, by means of the insertion of a region of the supply conduit having sharply reduced cross section, the length of the supply conduit which effects a pressure increase can be shortened so that at a constant end-of-delivery pressure, the pressure increase velocity can be increased in the remaining effective supply conduit region. Consequently the delivery pressure in the center of the whirl increases very quickly over the vapor pressure of the fuel, even when the fuel is highly heated. However, in order not to further increase the end-of-delivery pressure in the entire length of the supply conduit, which is preset by means of the position of the inlet and outlet openings, the region of the supply conduit which has a reduced cross section is designed so that the pressure exchange between the fuel in the supply conduit and the fuel accelerated in the impeller effects no pressure increase, but simply continuously maintains the pressure constant at its high level.

This region of the supply conduit which maintains the delivery pressure constant is advantageously disposed in the supply conduit so that it divides the two adjacent effective regions of the supply conduit into approximately equal sections, which are disposed as opposite to one another as possible via the circular, bow-shaped extension of the supply conduit so that the forces acting as fluid impulse on the impeller during the increase in delivery pressure are distributed in approximate symmetry over its circumference, which minimizes the bearing forces of the impeller.

The cross section reduction of the reduced region of the supply conduit in which a constant pressure level prevails is advantageously achieved by means of a reduction of the circular cross section of the supply conduit; the transitions to the adjoining conduit sections are sloped and so each forms a ramp.

The regions of the supply conduit which effect a pressure increase are designed according to the invention so that in both of them the delivery pressure is raised by the same amount and at the same pressure increase gradient, which advantageously makes possible a roughly symmetrical introduction of force onto the impeller and consequently makes possible a further reduction of the bearing forces.

For high efficiency of the feed pump, which is embodied as a side channel pump, it is particularly advantageous to dispose a supply conduit in both chamber walls which axially define the pump chamber, which conduits are embodied as symmetrical to one another and which communicate hydraulically with each other via the impeller which rotates between them.

With the formation of the supply conduit according to the invention it is therefore possible to maintain the feed behavior of a feed pump, which is embodied as a side channel pump, independent of the fuel temperature, which especially in two-stage delivery units has the result that the outlet pressure for the second pump stage can be reliably maintained at a high pressure level and consequently cavitation damage as a result of a formation of a vapor bubble can be reliably prevented.

The invention will be better understood and further objects and advantages thereof will become more apparent from the ensuing detailed description of a preferred embodiment taken in conjunction with the drawings.

DESCRIPTION OF THE PREFERRED EMBODIMENTS

Figure 1:
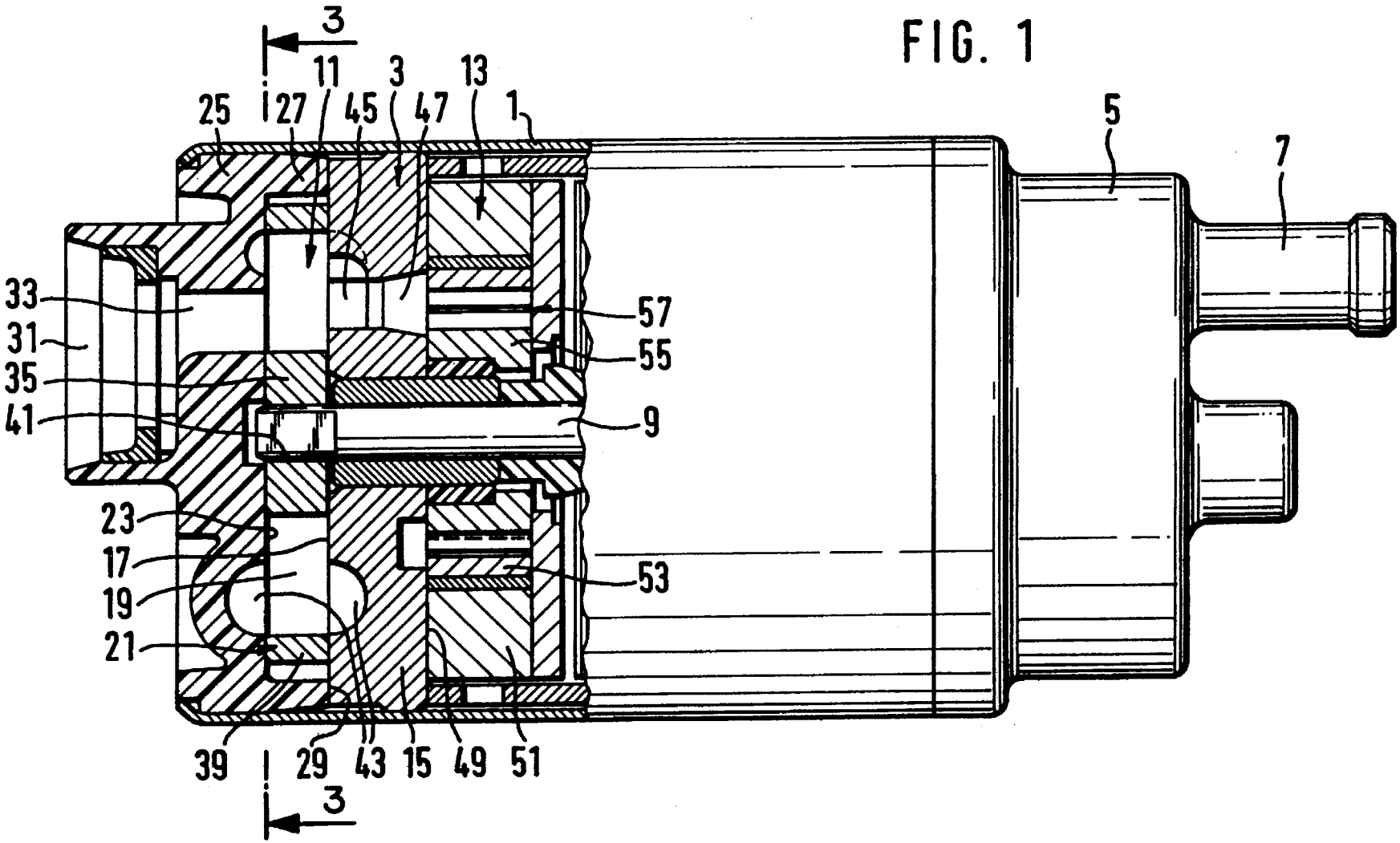
FIG. 1 shows a section through the part of the delivery unit which receives the two-stage feed pump.

The delivery unit shown in FIG. 1 serves to deliver fuel from a fuel supply tank, not shown, to an engine of a motor vehicle, likewise not shown.

The delivery unit has a tubular housing 1 whose one tube mouth is closed by means of a feed pump 3 and whose other end is closed by means of a connecting cover 5, which has a pressure fitting 7 to which a feed line, not shown, is connected, which leads to the engine. An electric drive motor, likewise not shown, is inserted in the housing between the connecting cover 5 and the feed pump 3; the rotor shaft 9 of this electric motor protrudes into the feed pump 3 and drives it to rotate.

The feed pump 3 has two pump stages; the preliminary stage is constituted by means of a side channel pump 11 and the main stage is constituted by means of an internal gear pump 13, which is disposed axially downstream of the side channel pump 11 and communicates hydraulically with it.

The free part of the rotor shaft 9 protrudes through a base plate 15, which is disposed fixed in the housing 1 and which divides the preliminary and main stages, that is the side channel pump 11 and the internal gear pump 13, from one another. The face wall 17 of the base plate 15 oriented toward the free end of the rotor shaft 9 defines a pump chamber 19, in which an impeller 21 of the side channel pump 11 revolves. The pump chamber is closed off by means of a second defining wall 23 spaced away from the face wall 17, which defining wall 23 is embodied as a so-called connecting cover 25, which sealingly closes the housing 1. The connecting cover 25 has a circular edge 27, whose height from the defining wall 23 roughly corresponds to the width of the impeller 21, guided in the pump chamber 19. The circular edge 27 rests with its free face end 29 against the face wall 17 of the base plate 15 and thus defines the cylinder-shaped pump chamber 19 on its outer circumference. Furthermore, the connecting cover 25 has an inlet fitting 31 pointing away from the pump chamber 19, which in the direction of the pump chamber 19 changes into an inlet opening 33.

Figure 2:
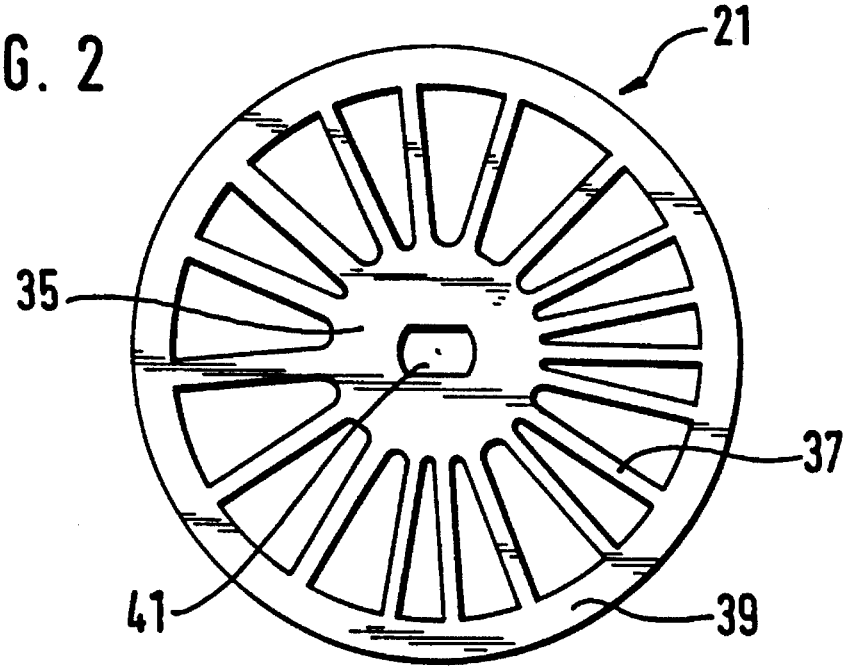
FIG. 2 shows the impeller of the side channel pump which constitutes the first pump stage.

The embodiment of the impeller 21 can be inferred from FIGS. 1 and 2. The impeller 21 has an essentially disk-shaped hub part 35, having a plurality of blades 37 disposed on its circumferencial face, which constitute the feed members of the impeller 21. The free ends of the blades 37 are attached to each other by means of a ring 39 disposed concentric to the axis of the impeller. To achieve a nonrotating attachment to the free end of the rotor shaft 9, the impeller 21 additionally has a flat profile shaped recess 41 in the hub part 35 with which it is guided via so-called dihedral slaving on a corresponding profile of the rotor shaft so that it produces a positive fit.

Figure 4:
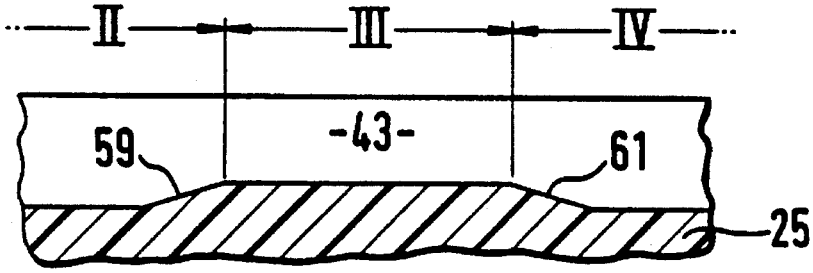
FIGS. 4 and 5 show sections along line 4—4 and 5—5, respectively of the connecting cover from different views.

The impeller 21 is guided inside the pump chamber 19; the face end chamber walls of the pump chamber 19, which are constituted of the face wall 17 and the defining wall 23, each have, in the region of the blade ends, a partially ring-shaped supply conduit 43, which constitutes a side conduit, disposed around the rotational axis of the impeller 21. These supply conduits 43, which are embodied symmetrically to each other and which communicate hydraulically with one another via the impeller 21, in cross section are shaped like segments of a circle and extend from the inlet opening 33 in the connecting cover 25 in a ring shape to an outlet opening 45 in the base plate 15; a bridge which interrupts the partially ring-shaped supply conduit 43 is left over between the inlet opening 33 and the outlet opening 45. Toward the internal gear pump 13, the outlet opening 45 changes into an inlet opening 47 into the pump and constitutes with it an overflow conduit; the face wall 49 oriented toward the internal gear pump 13 also constitutes the limit of the pump chamber 57 of the internal gear pump 13, which is comprised of an outer ring 51 permanently inserted in the housing 1; an internal gear 53 is guided in the bore of the outer ring 51 whose internal gearing meshes with the outer gearing of a pinion 55 which is nonrotatably attached to the rotor shaft 9 and which is guided eccentrically to the internal gear 53. The embodiment of the supply conduit 43 according to the invention should be further embodied according to FIGS. 3–5, which show its disposition, shape, and course in the connecting cover 25.

Figure 3:
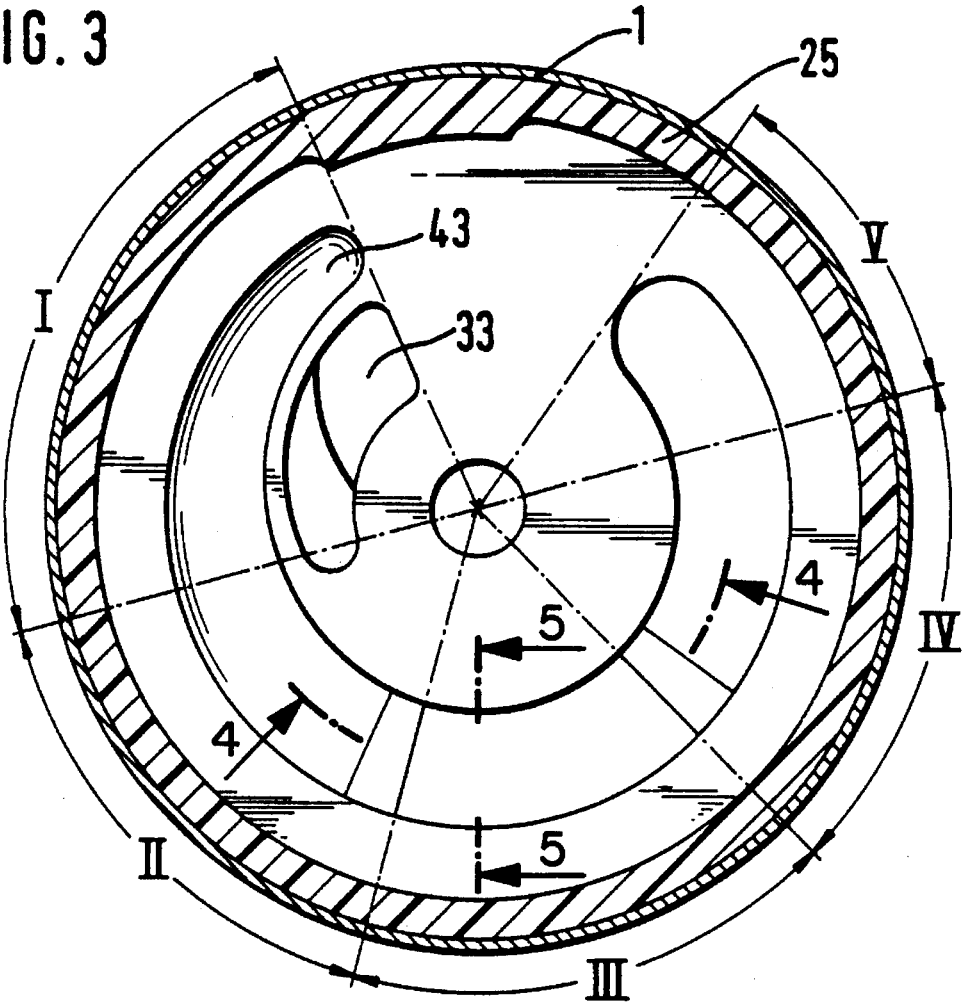
FIG. 3 shows a section along lines 3—3 of the delivery unit shown in FIG. 1 which shows the course of the supply conduit in the connecting cover of the side channel pump.

The supply conduit 43, as shown in FIG. 3, extends from the region of the inlet opening 33 into the connecting cover 25, with which it communicates via the pump chamber 19 and the impeller 21 over an angle of roughly 300° to inside the region of the outlet opening 45 disposed in the base plate 15; the remaining region of roughly 60° is closed by means of the face end chamber walls 17, 23 in such a way that in this region only a small axial gap remains between impeller 21 and chamber walls 17, 23.

The supply conduit 43, which is circular in cross section and whose width increases slightly in the direction of the outlet opening 45, is divided in its course into five regions; the shape of the supply conduit 43 disposed in the connecting cover 25 is diametrically equal to that of the supply conduit 43 disposed in the base plate 15.

The first region I extends at the level of the inlet opening 33 over an angle of about 80°; in the region of the inlet opening 43, the supply conduit 43 has its smallest cross section in order to guarantee a reliable inlet of the fuel.

Figure 5:
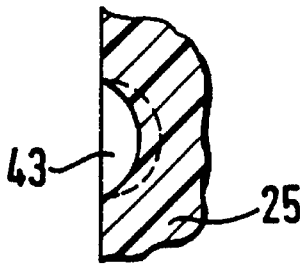

As its course continues the first region I is adjoined by a second region II which has a constant conduit depth in the course of increasing the cross section face of the supply conduit 43. In its region of transition to a third supply conduit region III, the second region II has a steady reduction of the conduit depth as can be inferred from the section through the supply conduit 43 shown in FIG. 4. This reduction in cross section is formed via a first sloping 59, which connects the second region II to the third region III of the supply conduit 43 and which consequently forms a ramp, which leads to a flattening of the cross section of the supply conduit 43. The reduction of the canal depth in the third region III also shown in FIG. 5 is designed so that the pressure of the fuel flowing through remains constant there. In the further continuation of the supply conduit 43, the third, cross sectionally reduced region III adjoins a fourth region IV, in which the cross section of the supply conduit 43 increases again to a certain measure via a second sloping 61; the conduit depth remains constant again in the fourth region IV. As it continues, the fourth conduit region IV adjoins a fifth conduit region V, which is overlapped by the outlet opening 45 in the base plate 15 so that the fuel flows from there into the internal gear pump 13.

The supply conduit regions II—IV constitute an effective supply region of the partially ring-shaped supply conduit 43, which extends over approximately 180°. The individual regions II—IV of the supply conduit 43 have roughly the same extension in the circumference direction; in particular, the second and fourth regions are designed so that the pressure increases of the fuel there have the same value.

The delivery unit according to the invention functions as follows:

The revolving electric drive motor drives the impeller of the side channel pump 11 and the pinion 55 of the internal gear pump 13 via the rotor shaft 9.

First the side channel pump 11 sucks the fuel via the inlet opening 33 into the pump chamber 19 and the supply conduit 43, where the fuel then changes in a known manner to a screw-shaped revolving flow (whirling flow). This revolving flow is produced by means of the steady impulse exchange between the fuel radially accelerated inside of the impeller 21 and the fuel in the supply conduit 43, by means of which the pressure of the fuel flowing through the supply conduit 43 increases from the inlet opening 33 to the outlet opening 45.

Figure 6:
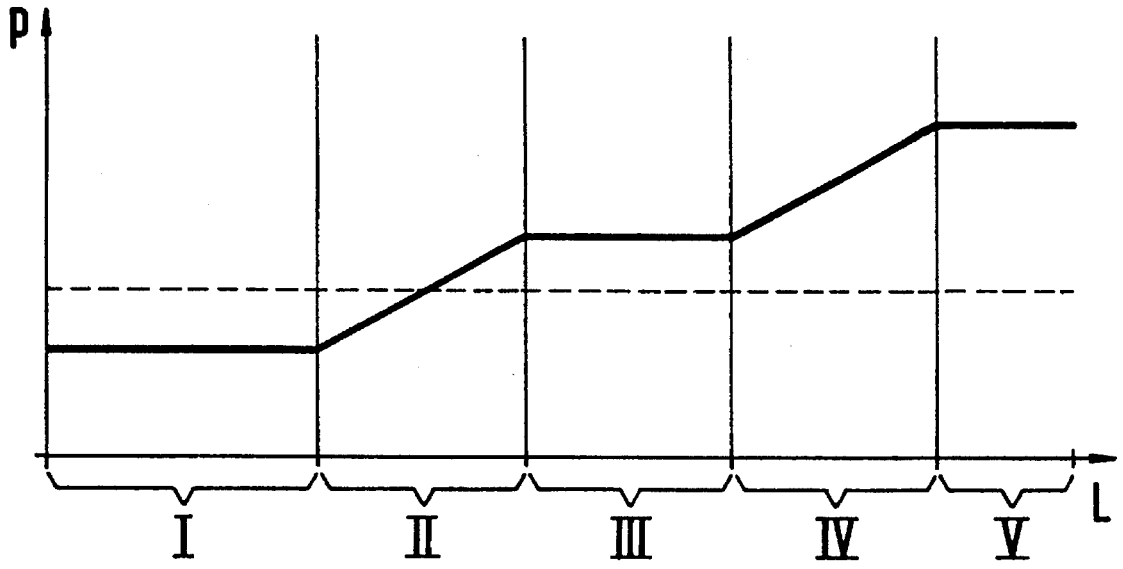
FIG. 6 shows a diagram in which the march of pressure of the fuel while flowing through the individual regions of the supply conduit of the side channel pump.

The course of the pressure increase of the fuel flowing through the supply conduit of the side channel pump 11 should be explained by the diagram shown in FIG. 6, in which the path of pressure (P) of the fuel upon flowing through the supply conduit 43 is plotted over the length (L) of the supply conduit 43; the individual transition regions between the regions of the supply conduit 43 are negligible. During its flow first into the supply conduit region I, the fuel more or less retains its outlet pressure. With the replacement of the cover with the inlet opening 33, the fuel pressure increases in the second region II in a known manner; the supply conduit 43 has a large conduit depth in the second region II so that as a result of the great pressure differential between impeller 21 and supply conduit 43, the fuel pressure quickly increases over the vapor pressure. In order to prevent the end pressure of the side channel pump from exceeding a certain value, now the third conduit region III follows, which maintains the fuel pressure at a constant high level, whose conduit depth is designed so that no pressure exchange occurs there between the fuel accelerated by the impeller 21 and the fuel flowing around in the supply conduit 43, which would increase the pressure in the supply conduit 43. Continuing on, the fuel pressure increases steadily once again in the fourth conduit region IV, which has a renewed increase of the conduit depth and of the attendant impulse exchange between the fuel in the impeller 21 and the fuel in the supply conduit 43; by basing the equal division of the introduction of force onto the impeller 21, the second and fourth conduit regions are designed so that the amount of the pressure increase of each is roughly the same. At the end of the fourth region IV, the fuel reaches its end pressure in the side channel pump 11 and flows in the fifth region V at a high pressure into the outlet opening 45 and then via the inlet opening 47 into the pump chamber 57 of the internal gear pump 13, where the fuel pressure is increased once more in a known manner, before the fuel then flows along the drive motor into the pressure fitting 7.

In the remaining bridge region between the inlet opening 33 and the outlet opening 45 of the pump chamber 19, no impulse exchange occurs between the fuel in the impeller 21 and the pump chamber 19 by means of the slight axial gap between impeller 21 and chamber wall so that the pressure impulse merely supports the rotating motion of the impeller 21; the fuel pressure decreases so that in the conduit region I, fuel from the inlet opening 33 can be taken in.

By means of this shortening of the length of the supply conduit of the side channel pump, which length is effective for a continual pressure increase, maintaining a constant total length of the supply conduit and the same end-of-delivery pressure, it is consequently possible to quickly increase the fuel delivery pressure over the vapor pressure and thus to avoid cavitation damage, particularly in a second pump stage; the division of the effective length of the supply conduit into two regions, moreover, makes possible the advantage of a nearly symmetrical introduction of force onto the impeller, which leads to a reduction of the bearing forces and therefore, due to the reduced wear, lengthens service life of the entire delivery unit.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A device for delivering fuel from a supply tank to an internal combustion engine of a motor vehicle, comprising a pump chamber, a revolving impeller (21), which is driven to rotate in said pump chamber (19) by an electric drive motor, said impeller has a disk-shaped hub part (35) disposed on a rotor shaft (9) of the drive motor, a plurality of blades (37) which extend radially outward to outer ends are disposed on a circumference of said disk-shaped hub, at least one partially ring-shaped supply conduit (43) which has a semicircular cross section and which is disposed in chamber walls (17 and 23) which define face ends of the pump chamber (19), in a region of the outer ends of the blades of the impeller (21), said supply conduit (43) extends around the rotational axis of the impeller (21) and leads from an inlet opening (33) for the fuel to be fed into the pump chamber (19) to an outlet opening (45) for fuel from the pump chamber (19) which has been raised to delivery pressure, the supply conduit (43) has a cross sectionally reduced region (III) between the inlet opening (33) and the outlet opening (45), which is defined by adjoining regions (II, IV) of the supply conduit (43), each of which have a greater cross section than the cross sectionally reduced region (III).

2. The device according to claim 1, in which the cross sectionally reduced region (III) of the supply conduit (43) is constituted by means of flattening a portion of a semicircular cross section of the supply conduit (43), wherein a transition from the cross sectionally reduced region (III) to the adjoining regions (II, IV) occurs via a stopping section (59, 61) of the supply conduit (43), each of which have a larger cross section than that of the cross sectionally reduced region (III).

3. The device according to claim 1, in which the cross sectionally reduced region (III) is disposed in the supply conduit (43) so that the adjoining regions (II, IV) of the supply conduit (43) which have larger cross sections adjoining the cross sectionally reduced region (III), in which said adjoining regions (II, IV) adjoin the inlet and outlet openings (33, 45) respectively, extensions of said adjoining regions (II, IV) toward a circumference of the supply conduit (43) are of the same size.

4. The device according to claim 3, in which a length of the supply conduit (II, III, IV) effective for a pressure increase of the fuel flowing through the pump extends between the inlet opening (33) and the outlet opening (45) over an angular region of about 180°.

5. The device according to claim 2, in which the conduit depth of the cross sectionally reduced region (III) of the supply conduit (43) is designed so that the pressure of the fuel flowing through remains constant in this region.

6. The device according to claim 3, in which the adjoining regions (II, IV) of the supply conduit (43) are sized so that the amount of the pressure increase of the fuel flowing through them is substantially the same.

7. The device according to claim 1, in which a supply conduit (43) is disposed in each of the two face end chamber walls (17, 23) in a region of the outer blade ends of the impeller (21), each of which supply conduits is embodied as having a course which is diametrically symmetrical to the other.

8. The device according to claim 1, in which the feed pump (3) has two pump stages, a preliminary stage, which is constituted by means of a side channel pump (11) comprised of pump chamber (19), supply conduit (43), and impeller (21) that revolves in said pump chamber (19), and a main stage adjoining said preliminary stage by means of an overflow conduit (45, 47), which stage is constituted of an internal gear pump (13) likewise driven to rotate by the electric drive motor.

* * * * *